US005358028A

United States Patent [19]

Keutgen et al.

[11] Patent Number: 5,358,028

[45] Date of Patent: Oct. 25, 1994

[54] HORIZONTAL MULTIPLE-STRAND CONTINUOUS CASTING PLANT AND METHOD OF OPERATING THE PLANT

[75] Inventors: Franz Keutgen; Heinz-Josef Leuwer, both of Lissendorf; Dieter Perings, Büdesheim; Joachim Von Schnakenburg, Hillesheim; Dietmar Zebrowski, Straelen-Herongen; Peter Stadler, Netphen; Rüdiger Winterhager, Freudenberg, all of Fed. Rep. of Germany

[73] Assignee: Mannesmann Aktiengesellschaft, Dusseldorf, Fed. Rep. of Germany

[21] Appl. No.: 75,130

[22] Filed: Jun. 10, 1993

[30] Foreign Application Priority Data

Jun. 10, 1992 [DE] Fed. Rep. of Germany ..... 4219335

[51] Int. Cl.[5] ..... B22D 11/128; B22D 11/20; B22D 11/124

[52] U.S. Cl. ..... 164/478; 164/454; 164/484; 164/485; 164/440; 164/441; 164/420; 164/490

[58] Field of Search ..... 164/150, 413, 420, 440, 164/441, 451, 454, 478, 484, 490, 485

[56] References Cited

U.S. PATENT DOCUMENTS

| | | | |
|---|---|---|---|
| 3,563,297 | 2/1971 | Wertli | 164/441 |
| 3,730,251 | 5/1973 | Webbere et al. | 164/485 |
| 4,244,420 | 1/1981 | Dain | 164/443 |
| 4,291,747 | 9/1981 | Sevastakis | 164/420 |
| 4,436,143 | 3/1984 | Sevastakis | 164/420 |
| 4,480,679 | 11/1984 | Katschinski | 164/420 |
| 4,884,624 | 12/1989 | Pleschiutschnigg | 164/454 |
| 4,911,224 | 3/1990 | Keutgen et al. | 164/484 |

FOREIGN PATENT DOCUMENTS

| | | | |
|---|---|---|---|
| 6475158 | 3/1989 | Japan | 164/484 |
| 1000845 | 8/1965 | United Kingdom | 164/420 |

*Primary Examiner*—P. Austin Bradley
*Assistant Examiner*—Erik R. Puknys
*Attorney, Agent, or Firm*—Cohen, Pontani, Lieberman, Pavane

[57] ABSTRACT

A horizontal multiple-strand continuous casting plant and a method of operating the plant. The casting plant includes a distributor with several molds and a corresponding strand drawing unit which conveys the individual strands out of the molds by means of pulling movements and return pushing movements, wherein the strands can be individually clamped within the strand drawing unit. The strand drawing unit includes two clamping devices which alternatingly carry out the pulling movements and the return pushing movements. In the event of an interruption in one of the molds, the method includes connecting in a frictionally engaging manner the strand located in the affected mold to one of the two clamping devices of the strand drawing unit by actuating the corresponding clamping device only during at least one return pushing movement, and disconnecting from this strand the second clamping unit during the pulling movement thereof. The distributor of the casting plant has discharge openings arranged in a side wall of the distributor. The number of discharge openings corresponds to the number of strands being produced. A mold is provided for each of the discharge openings. The molds are combined into a mold block and are arranged in recesses of a housing of the mold block. The axes of the recesses of the housing are in alignment with the axes of the discharge openings of the distributor. Each strand drawing unit has a lower clamping plate in common for all strands and an upper clamping plate for each of the strands, wherein each clamping plate is controllable by a clamping cylinder and is fastened to this clamping cylinder. The lower and upper clamping plates including the clamping cylinders are mounted in a drawing frame. A drive means is mounted on the drawing frame for moving the drawing frame in axial direction of the strand. The upper clamping plates or the clamping cylinders are arranged on the drawing frame in such a way that the axes of the clamping cylinders intersect the axes of the discharge openings.

10 Claims, 4 Drawing Sheets

(C-C)

HORIZONTAL MULTIPLE-STRAND CONTINUOUS CASTING PLANT AND METHOD OF OPERATING THE PLANT

BACKGROUND OF THE INVENTION

1. Field of the Invention

The present invention relates to a horizontal multiple-strand continuous casting plant and a method of operating the horizontal multiple-strand continuous casting plant.

2. Description of the Related Art

Horizontal multiple-strand continuous casting plants are known, for example, from EP 0 239 919 A2 or DE 26 58 242 A1. Plants of this type are essentially composed of a distributing vessel with several individual molds, wherein the molds are fastened either directly to the distributing vessel or through an intermediate plate, and strand conveying units or drawing units and strand separating units, wherein the number of units corresponds to the number of the produced strands.

The strand drawing units are either driven rollers or a hydraulically adjustable clamping jaw system which is movable in axial direction of the strand (DE-U1 85 22 740.1).

In case of interruptions in individual strands during the casting operation, the melt supply from the distributor to the mold is cut off by means of gate-type valves arranged between the distributor and the mold.

Plants of this type require complicated machinery and are disadvantageous with respect to casting technology, especially because of the large distance between the individual molds. Also, the space required by the plants is very large.

SUMMARY OF THE INVENTION

Therefore, primary object of the present invention, especially when casting large quantities of melt into strands having a small cross-sectional area, to accommodate within a very narrow space a number of casting strands which is as large as possible, to improve the temperature pattern of the melt in the distributor and to reduce the size and quantity of the machinery.

In accordance with the present invention, a horizontal multiple-strand continuous casting plant for producing strands of iron materials includes a distributor with several molds and a corresponding strand drawing unit which conveys the individual strands out of the molds by means of pulling movements and return pushing movements, wherein the strands can be individually clamped within the strand drawing unit. The strand drawing unit includes two clamping devices which alternatingly carry out the pulling movements and the return pushing movements.

The method according to the present invention includes, in the event of an interruption in one of the molds, connecting in a frictionally engaging manner the strand located in the affected mold to one of the two clamping devices of the strand drawing unit by actuating the corresponding clamping device only during at least one return pushing movement, and disconnecting from this strand the second clamping device during the pulling movement thereof.

In the horizontal multiple-strand continuous casting plant according to the present invention, the distributor has discharge openings arranged in a side wall of the distributor, wherein the number of discharge openings corresponds to the number of strands to be produced. A mold is provided for each of the discharge openings. The molds are combined into a mold block and are arranged in recesses of a housing of the mold block. The axes of the recesses of the housing are in alignment with the axes of the discharge openings of the distributor.

In accordance with another embodiment of the present invention, the strand drawing unit has a lower clamping plate in common for all strands and an upper clamping plate for each of the strands, wherein each clamping plate is controllable by a clamping cylinder and is fastened to this clamping cylinder. The lower and upper clamping plates including the clamping cylinders are mounted in a drawing frame. A drive means is mounted on the drawing frame for moving the drawing frame in axial direction of the strand. The upper clamping plates or the clamping cylinders are arranged on the drawing frame in such a way that the axes of the clamping cylinders intersect the axes of the discharge openings.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figures 1A, 1B:
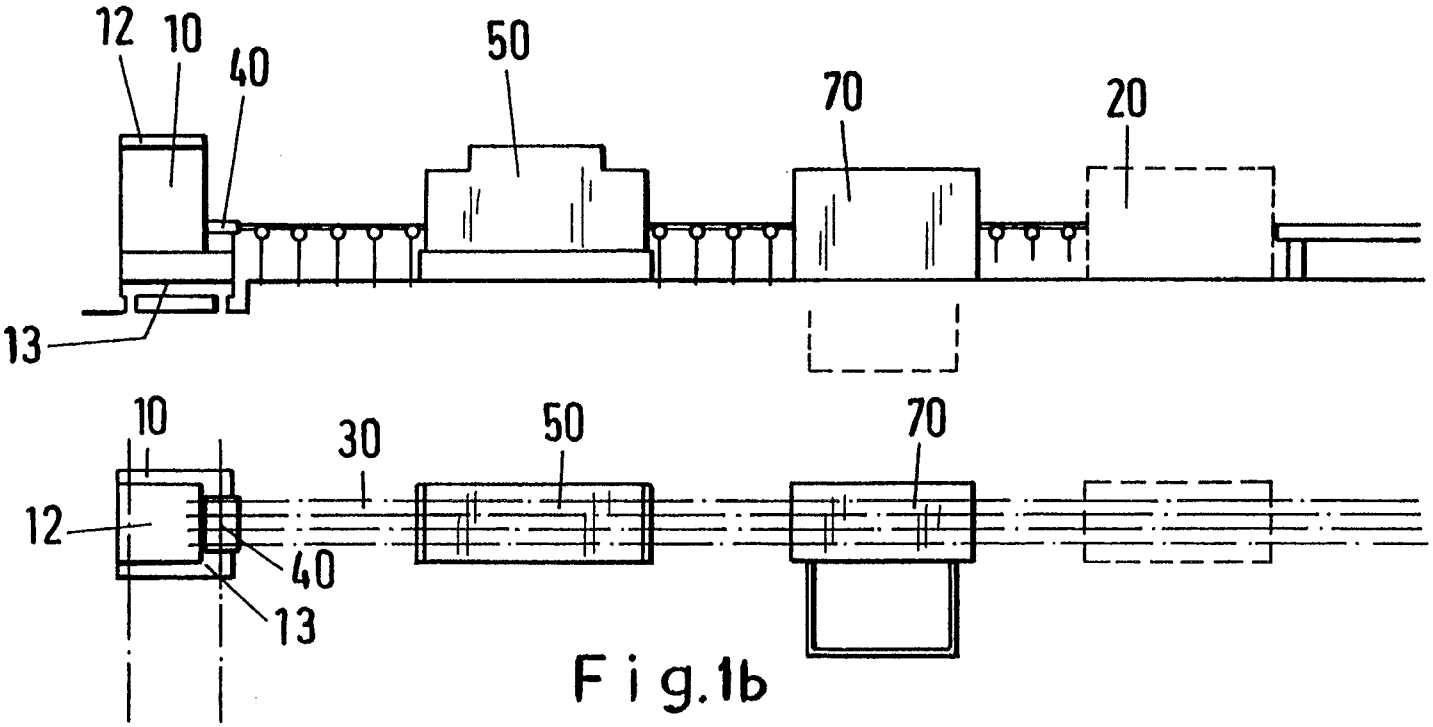
FIG. 1*a* is a schematic side view of a horizontal multiple-strand continuous casting plant according to the present invention.
FIG. 1*b* is a schematic top view of the plant of FIG. 1*a*.

As illustrated in FIGS. 1*a* and 1*b* of the drawing, the horizontal multiple-strand continuous casting plant includes a distributor 10 with cover 12 and distributor carriages 13 and a mold block 40 mounted on the distributor 10. The mold block 40 is followed at a distance by a strand drawing unit 50, a strand separating unit 70 and the strand separating unit 70 may be followed by a shaping or forming unit 20 for the strand 30.

Figure 4:
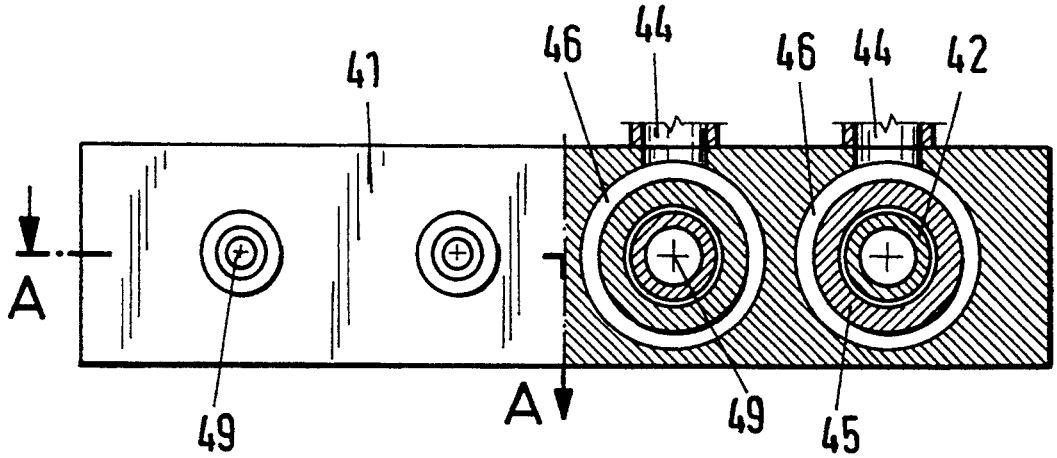
FIG. 4 is a front view of a mold block, partially in section taken along sectional line IV—IV in FIG. 5.
Figure 5:
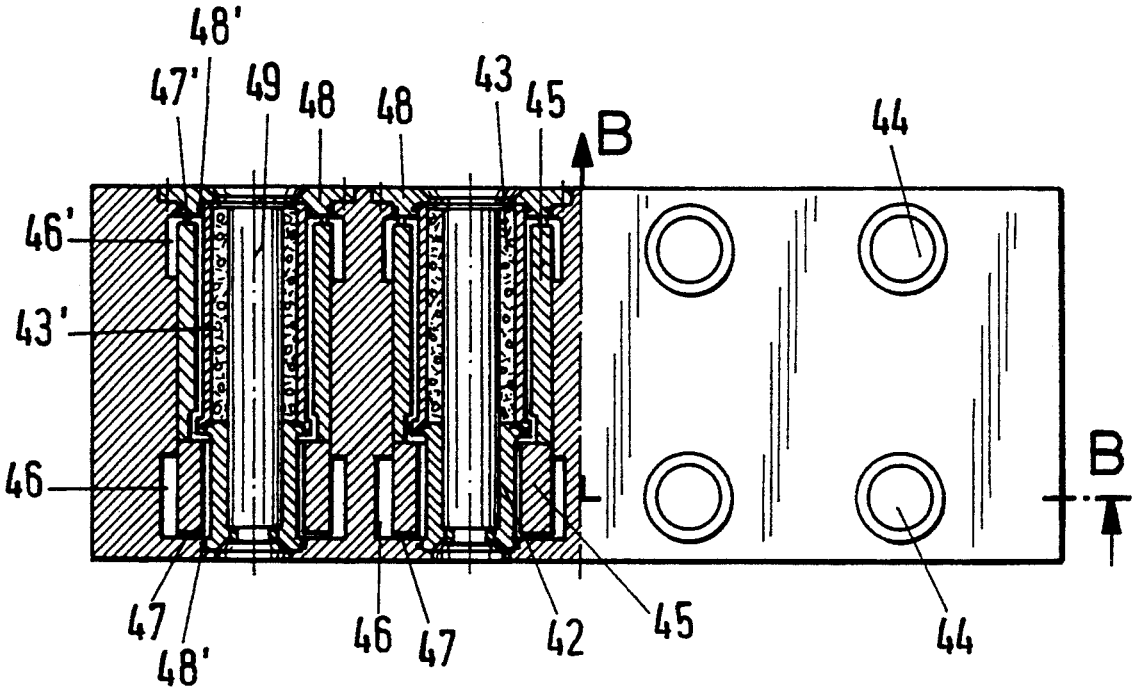
FIG. 5 is a top view of the mold block, partially in section taken along sectional line V—V of FIG. 4.

FIGS. 4 and 5 of the drawing show a mold block 40 which ensures a compact construction and small spacings between strands. The mold block 40 includes a housing 41 with several recesses. Each recess receives a mold. Each mold is composed of a mold housing 45 with a copper part 42 and a graphite part 43 mounted in the mold. The mold is water-cooled. The water is supplied for each mold through a pipe connection 44 of the housing 41. The water is conducted from the pipe connections 44 into ducts 46 of the housing 41 and the water reaches the gap defined by the mold housing 45 and the copper or graphite parts 42, 43 through cutouts 47, for example, bores. The water is removed at the end of the mold through cutouts 47' and ducts 46'. The recesses for receiving the molds in the mold block are dimensioned in such a way that the molds having the largest size can be received. When molds having a smaller size are used, a diameter compensation is carried out, for example, by increasing the thickness of the mold housing 45 in order to adjust a desired gap width between mold housing 45 and copper part 42 or graphite part 43. The mold is secured in the housing 41 by means of a flange ring 48 at the discharge end of the mold.

Figure 6:
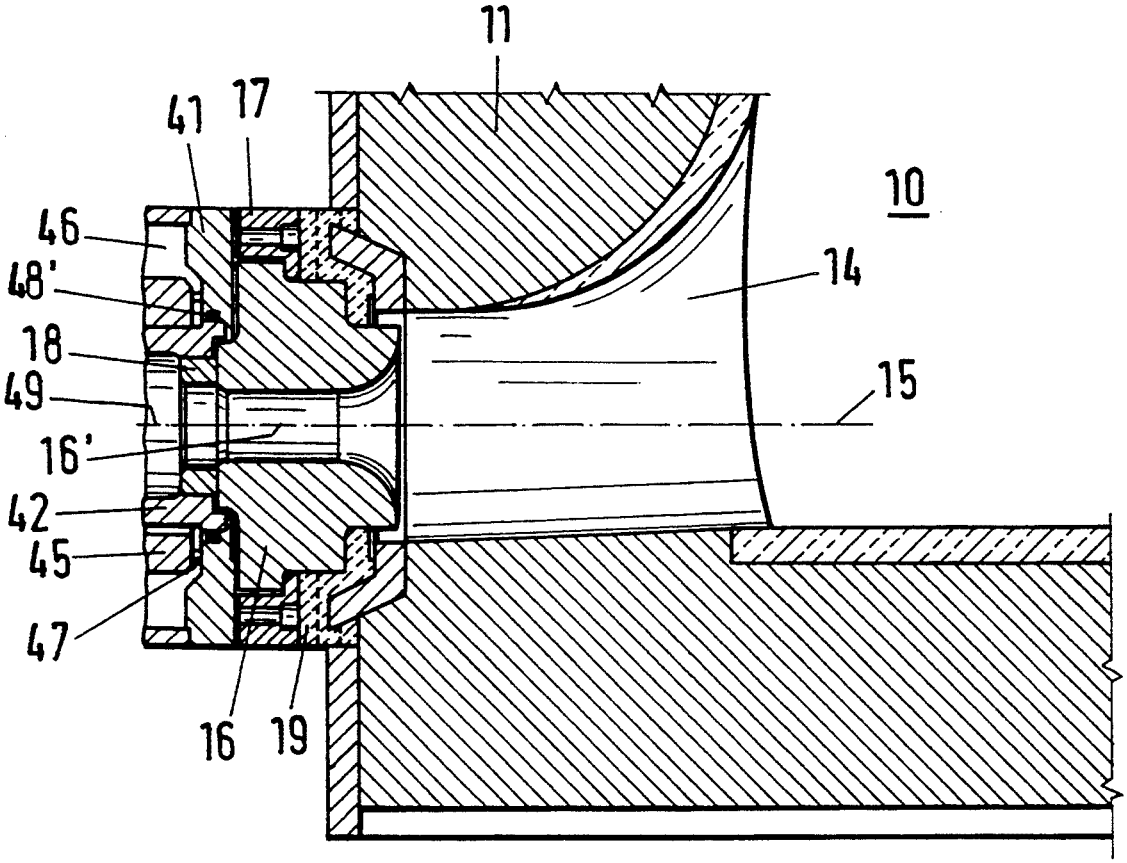
FIG. 6 is a sectional view showing a connection between mold block and distributor.

The mold block 40 is fastened to the distributor 10 in the known manner by suitable means, for example, gripping cylinders. The transition from the distributor 10 to the mold block 40 is illustrated in more detail in FIG. 6. The distributor 10 has discharge openings 14 in the side wail 11. The number of discharge openings 14 corresponds to the number of strands to be produced. In the assembled state, the axes 49 of the recesses in the housing 41 coincide with the axes of the molds 42, 43, 45 and they are preferably in alignment with the axes 15 of the discharge openings 14 of the distributor 10. However, a slight misalignment of the axes is not harmful. A runner brick 16 is arranged on the end face of the housing 41 of the mold block 40 facing the distributor 10. The runner brick 16 is supported by a ring 17 with an inwardly directed flange and is pressed against a boric nitride ring 18 on the inlet side of the mold part 42. The housing 41 is sealed relative to the distributor 10 by means of ff-substance 19.

Figure 3:
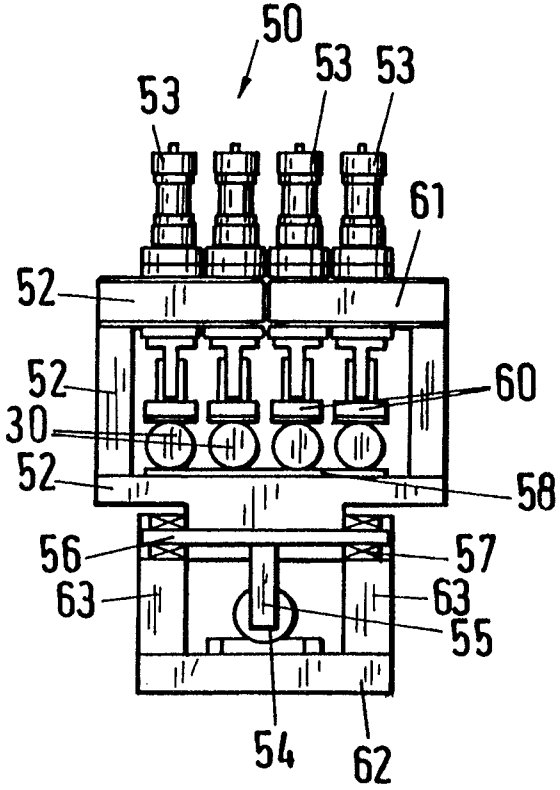
FIG. 3 is a sectional view taken along sectional line III—III of FIG. 2.
Figure 2:
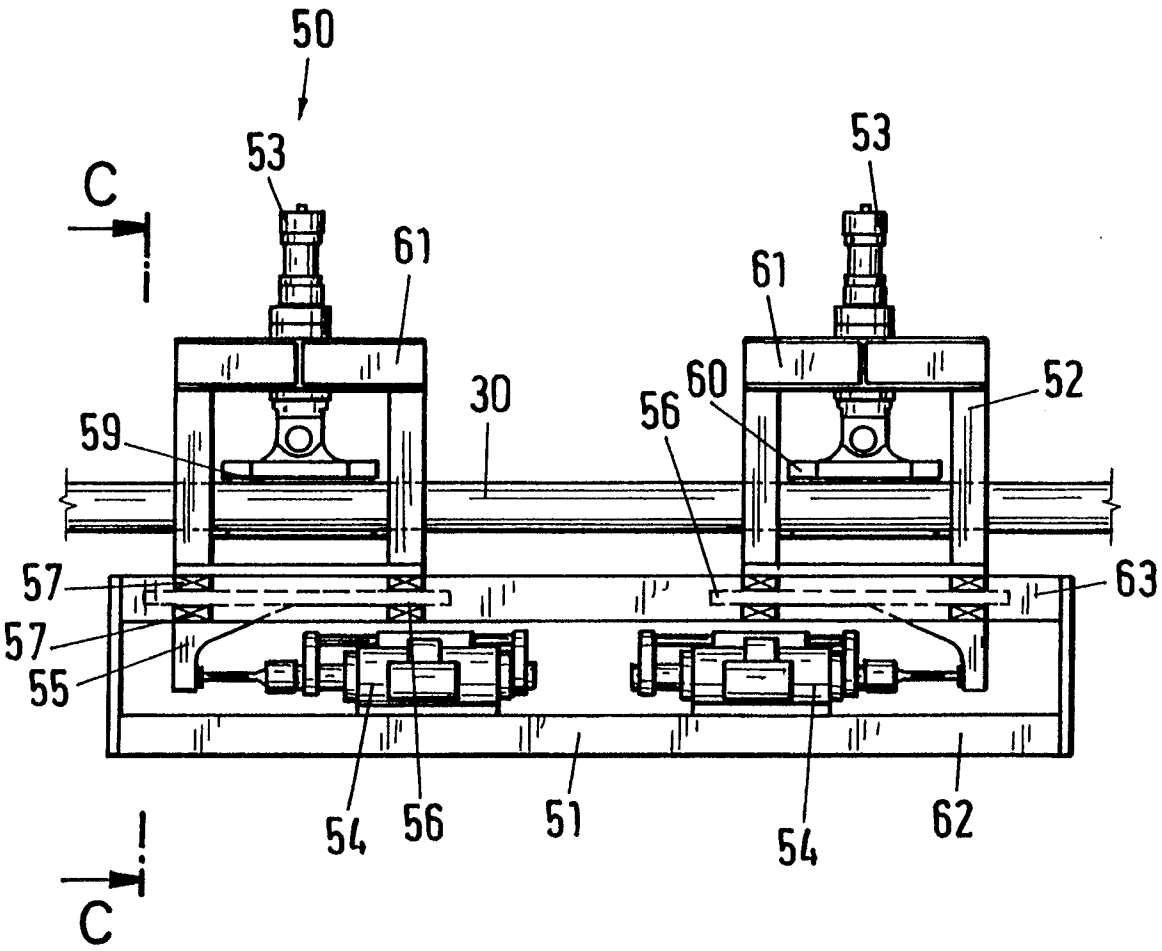
FIG. 2 is a side view, on a larger scale, of a strand drawing unit of the horizontal multiple strand continuous casting plant.

FIGS. 2 and 3 of the drawing show a strand drawing unit 50 for the strands 30. Two drawing devices which form the strand drawing unit 50 are arranged one behind the other in the drawing direction of the strands 30. The drawing devices can be connected alternatingly one after the other in a frictionally engaging manner with the strands 30. The strand is drawn in a stepwise manner by one of the drawing devices which at a given time is connected in a frictionally engaging manner with the strands, while the other drawing device is returned during this time into its initial position. The reciprocating movements of the drawing devices of the strand drawing unit 50 is effected by actuating drawing cylinders 54 which are mounted on a base frame 51. The piston rods of the drawing cylinders 54 act on a drive member 55 which is a component of the drawing frame 52.

The bottom of the drawing frame 52 is dovetail-shaped at 56 and is supported on both sides thereof by roller bearings 57 mounted in the base frame 51. The strands 30 rest on a common lower clamping plate 58 which is fastened on a lower transverse yoke 59 of the drawing frame 52. For the frictionally engaging connection of the strands 30 with the drawing frame 52, a separate upper clamping plate 60 is provided for each strand. Each upper clamping plate 60 can be pressed against the respective strand by means of a clamping cylinder 53. The clamping cylinders 53 are mounted on an upper transverse yoke 61 of the drawing frame 52.

For example, as schematically illustrated in FIG. 1*b*, four strands having approximately the same cross-section are moved by means of the above-described strand drawing unit in the same direction and simultaneously by actuating the drawing cylinders 54, after the strands are frictionally engaged in the drawing frame 52 by moving the clamping jaws 60 by means of the clamping cylinders 53 against the strands. The cross-sectional shapes of the strands may be, for example, round, square or the like.

The drawing devices which are illustrated in FIG. 2 and are arranged one behind the other are moved in opposite directions, i.e., while one drawing device is connected in a frictionally engaging manner with the strands and carries out the conveying operation, the other drawing device is moved back into the initial position. The drawing device which is inclamped engagement with the strands and carries out the movement of the strands may move the strand uniformly or in a stepwise operation; in addition, the drawing device can carry out a return pushing movement of the strand in the direction toward the molds. The clamping cylinders 53 can be controlled individually, so that, in accordance with the present invention, when a problem occurs in individual strands or molds, the affected strand or strands is no longer clamped in the drawing device during the drawing movement, but the clamping jaws are only connected to the affected strand or strands during the return pushing movement of the drawing frame 52. The return pushing movement and the subsequent standstill of the strand prevents melt from flowing out the mold or out of the strand and casting of the remaining strands can be concluded.

The plant according to the present invention can be used when large quantities of melt are to be processed or if the final product is to have particularly small cross-sectional areas, for example, in the manufacture of wires. The advantages provided by the present invention are an improved crystalline structure of the final product and in a smaller number of processing stages.

The invention is not limited by the embodiments described above which are presented as examples only but can be modified in various ways within the scope of protection defined by the appended patent claims.

We claim:

1. A method of operating a horizontal multiple-strand continuous casting plant for producing strands of iron material, the casting plant including a distributor with a plurality of molds, and a strand drawing unit including first and second clamping devices for each strand, the clamping devices being alternatingly movable for clamping the strands for carrying out a pulling movement from an initial position for pulling the strands out of the molds and for releasing the strands for carrying out a return movement back into the initial position, as one clamping device carries out a pulling movement the other carries out a return movement, wherein the strands are clamped individually by the clamping devices during the pulling movements, the method comprising, in the event of a disruption in one of the molds during casting, actuating the first clamping device so as to clamp in a frictionally engaging manner the strand being cast by the disrupted mold during the return movement to carry out a back pushing movement, and disengaging the second clamping device from the strand during the pulling movement.

2. A horizontal multiple-strand continuous casting plant for producing strands of iron material, the casting plant comprising a distributor with a plurality of molds, and a strand drawing unit including first and second clamping devices for each strand, the clamping devices being alternatingly movable for carrying out a pulling movement from an initial position for pulling the strands out of the molds and for carrying out a return movement back into the initial position, wherein the strands are clamped individually by the clamping devices during the pulling movements, the distributor having a side wall, the side wall having a number of discharge openings, the number of discharge openings corresponding to the number of strands being cast, one of the molds being provided for each of the discharge openings, the molds being combined in a mold block, the mold block comprising a housing having recesses, the molds being arranged in the recesses of the housing, the recesses of the housing and the discharge openings of the distributor having axes, wherein the axes of the recesses of the housing are in alignment with the axes of the discharge openings of the distributor, the first and second clamping devices of the strand drawing unit have a common lower clamping plate for all strands and individual upper clamping plates for each strand, a clamping cylinder being fastened to each upper clamping plate for controlling the upper clamping plate, the clamping cylinders having axes that intersect the axes of the discharge openings.

3. The casting plant according to claim 2, wherein each mold has at an inlet side thereof, a copper portion and a subsequent graphite portion, a metal jacket surrounding the graphite portion, the copper portion, the graphite portion and the metal jacket forming a mold cavity for the strand, a mold housing surrounding the copper portion and the graphite portion with the metal jacket and defining a gap, the housing of the mold block having ducts, the gap of the mold housing being in communication through bores with the ducts in the housing of the mold block, the ducts being in communication with connections for a coolant supply and discharge means.

4. The casting plant according to claim 3, wherein the copper portion of the mold is connected at the inlet side thereof with the housing of the mold block and the metal jacket is connected at a mold outlet to a flange ring through sealing rings placed in recesses of the flange ring.

5. The casting plant according to claim 3, wherein the copper portion of the mold is connected at the inlet side thereof with the housing of the mold block and the metal jacket is connected at a mold outlet to a flange ring through sealing rings placed in recesses of the housing of the mold block.

6. The casting plant according to claim 3, comprising clamping means for fastening the housing of the mold block to the distributor, a runner brick mounted by means of a ring having an inwardly directed flange at an end face of the housing of the mold block, the discharge openings of the distributor being connected through the runner brick, the runner brick being sealed relative to the side wall of the distributor, and a breaker ring mounted on an opposite side in an inlet area of the copper portion of the mold, wherein the runner brick has axes, and wherein, in addition to the alignment of the axes of the discharge openings of the distributor with the axes of the recesses in the housing, the axes of the discharge openings of the distributor are in alignment with the axes of the runner brick.

7. The casting plant according to claim 6, wherein the breaker ring is of boric nitride.

8. A horizontal multiple-strand continuous casting plant for producing strands of iron material, the casting plant comprising a distributor with a plurality of molds, and a strand drawing unit including first and second clamping devices for each strand, the clamping devices being alternatingly movable for carrying out a pulling movement from an initial position for pulling the strands out of the molds and for carrying out a return movement back into the initial position, wherein the strands are clamped individually by the clamping devices during the pulling movements, wherein the first and second clamping devices of the strand drawing unit each have a common lower clamping plate for all strands and individual upper clamping plates for each strand, a clamping cylinder fastened to each upper clamping plate for controlling the upper clamping plate, the lower and the upper clamping plates and the clamping cylinders being mounted in a drawing frame, a drive means for moving the drawing frame in axial direction of the strands, the clamping cylinders and the discharge openings having axes, wherein the upper clamping plates and the clamping cylinders are mounted in the drawing frame in such a way that the axes of the clamping cylinders intersect the axes of the discharge openings.

9. The casting plant according to claim 8, wherein the drawing frames of the first and second clamping devices are mounted on a base frame, the base frame comprising a base plate, drawing cylinders for each clamping device being mounted on the base plate, guide rails being arranged above and laterally of the drawing cylinders, the guide rails extending parallel to the axes of the strands, each drawing frame having dovetail-shaped projections, two roller bearings each being arranged spaced apart one above the other on the guide rails, the dovetail-shaped projections of the drawing frame being in linear sliding engagement with the roller bearings.

10. The casting plant according to claim 9, comprising a drive member for connecting the drawing frame to a piston rod of the drawing cylinder, the drive member being arranged concentrically underneath the drawing frame.

* * * * *